US006712739B1

(12) United States Patent
Chen

(10) Patent No.: US 6,712,739 B1
(45) Date of Patent: Mar. 30, 2004

(54) STAIR CLIMBING EXERCISER

(76) Inventor: Tsung-Yu Chen, No. 23-4, Ting-Liao, San-Ho Tsun, Shiu-Shang Hsiang, Chiayi Hsien (TW)

( * ) Notice: Subject to any disclaimer, the term of this patent is extended or adjusted under 35 U.S.C. 154(b) by 0 days.

(21) Appl. No.: 10/424,914

(22) Filed: Apr. 29, 2003

(51) Int. Cl.[7] ..... A63B 22/04
(52) U.S. Cl. ..... 482/53
(58) Field of Search ..... 482/51–53, 70, 482/79, 80

(56) References Cited

U.S. PATENT DOCUMENTS 5,256,118 A * 10/1993 Chen ..... 482/53
5,298,002 A * 3/1994 Lin ..... 482/53
5,807,210 A * 9/1998 Devlin ..... 482/52
6,595,899 B2 * 7/2003 Liang ..... 482/53

* cited by examiner

*Primary Examiner*—Stephen R. Crow
(74) *Attorney, Agent, or Firm*—Rosenberg, Klein & Lee

(57) ABSTRACT

A stair climbing exerciser includes a frame with two links pivotably connected between two lugs on two rails of the frame and two cylinders are respectively connected to the two links and the frame. Each frame is connected to a pedal. An adjusting member is rotatably connected to two bolts extending from the two links so that the two links are pulled toward each other or pushed away from each other by rotating the adjusting member. By this way, the height of the two links and the pedals can be adjusted simultaneously.

2 Claims, 10 Drawing Sheets

STAIR CLIMBING EXERCISER

FIELD OF THE INVENTION

The present invention relates to stair climbing exerciser that has an adjusting member connected between two links so as to easily adjust the height of the two links simultaneously.

BACKGROUND OF THE INVENTION

A conventional stair climbing exerciser is disclosed in FIG. 11 and generally an H-shaped frame 11 and a protrusion 14 extends from one of tow transverse bars 12 of the frame 11. Two pedals 15 each have one end pivotably connected to the protrusion 14 by a shaft 13 and each pedal 15 is connected to a cylinder 16 which is pivotably connected between the pedal 15 and the bar 12. The user steps on the two pedals 15 and exerts a downward force to overcome the resistance of the cylinder 16. Another conventional stair climbing exerciser is disclosed in FIG. 12 and includes a frame with two triangular lugs and a swing member 351 is pivotably connected between the two lugs. Two pedals 34 are pivotably connected to two respective link assemblies 35, each of which includes two links which are pivotably connected between the swing member 351, the lugs and the pedals 34. An adjusting member 37 is threadedly extended through the swing member 351 and a link 36 of one of the link assemblies 35. A knob 39 is located at a top of the adjusting member 37. The user may rotate the knob 39 together with the adjusting member 37 to adjust the height that the link assembly 35 on the left side can be moved. This can only adjust the height of one of the two link assemblies 35 and the hole defined through the link 36 makes the link 36 to be weak in structural strength.

The present invention intends to provide a stair climbing exerciser that has an adjusting member connected between two pedals so as to adjust the two pedals within one action.

SUMMARY OF THE INVENTION

In accordance with one aspect of the present invention, there is provided a stair climbing exerciser which comprises a frame including two bars and two rails connected between the two bars. Two links each have a first end pivotably connected between two lugs on the two rails and two damping members each have a first end pivotably connected between the two rails and a second end of each of the damping members is pivotably connected to a second end of the link corresponding thereto. Each link has a bolt connected thereto and an adjusting member is rotatably connected to the two bolts so that the two links are pivoted by rotating the adjusting member. Two pedals are pivotably connected to the two respective second ends of the two links.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
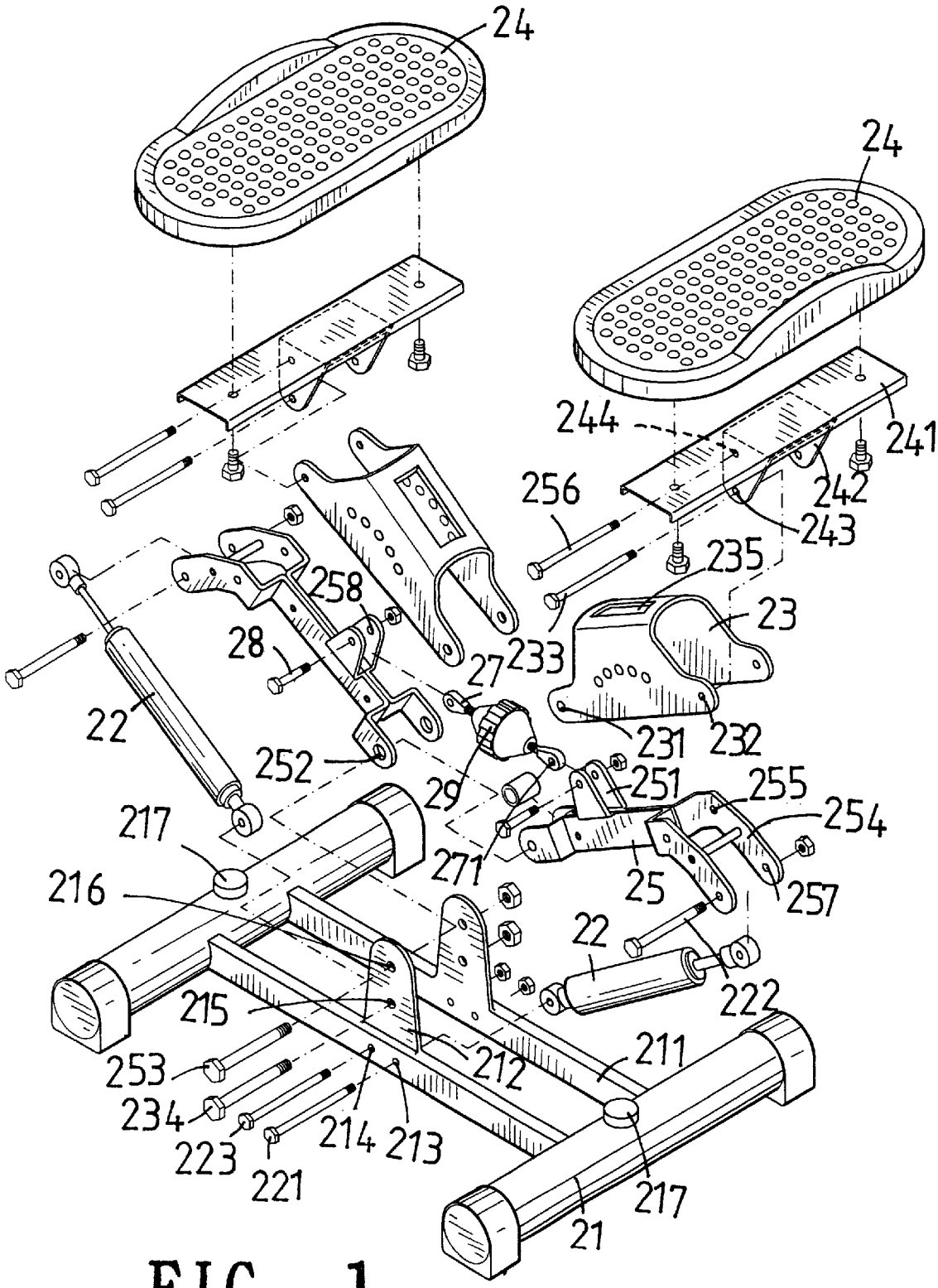
FIG. 1 is an exploded view to show the stair climbing exerciser of the present invention.
Figure 2:
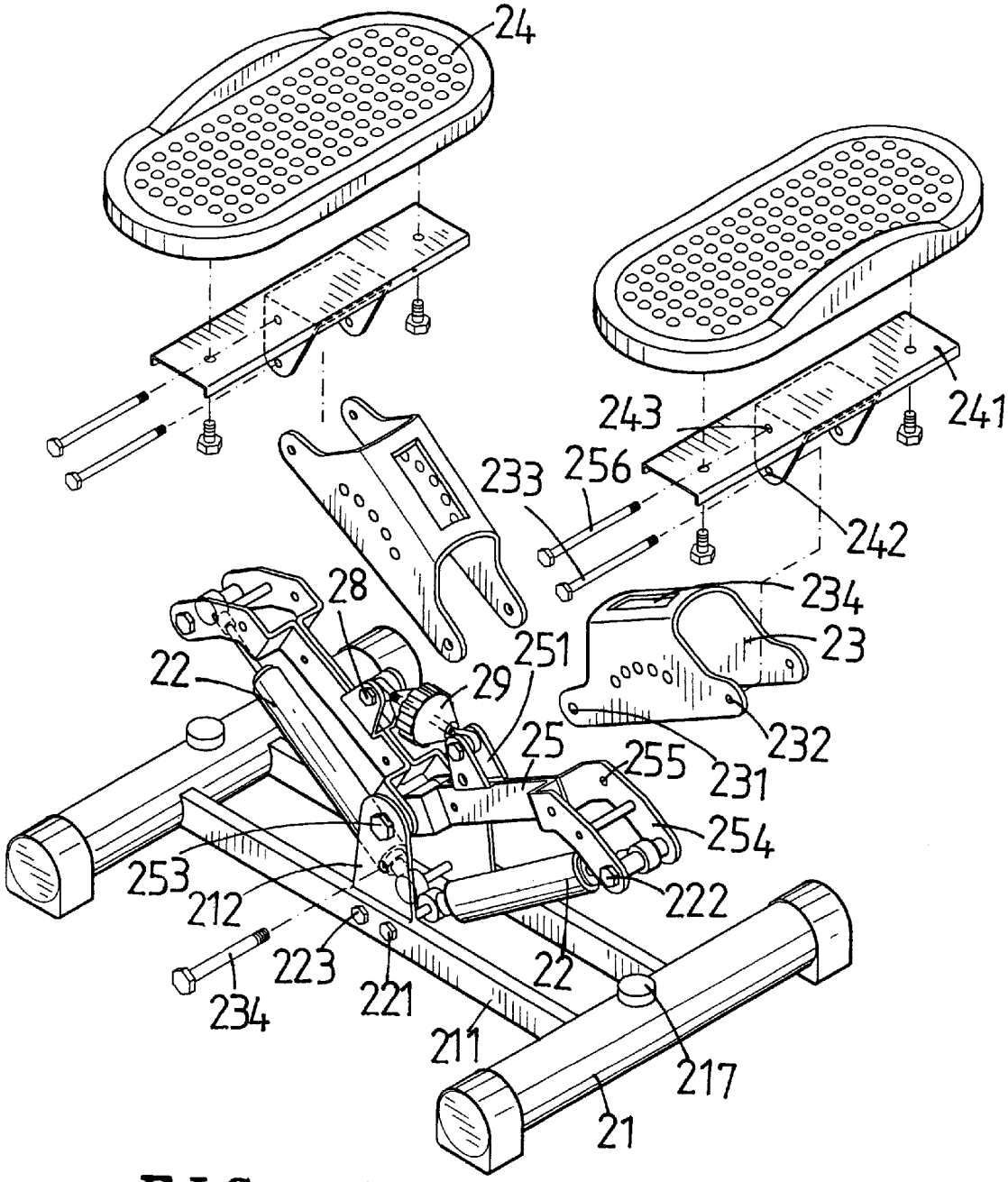
FIG. 2 is an exploded view to show the link covers, the pedals and the assembled part of the stair climbing exerciser of the present invention.
Figure 3:
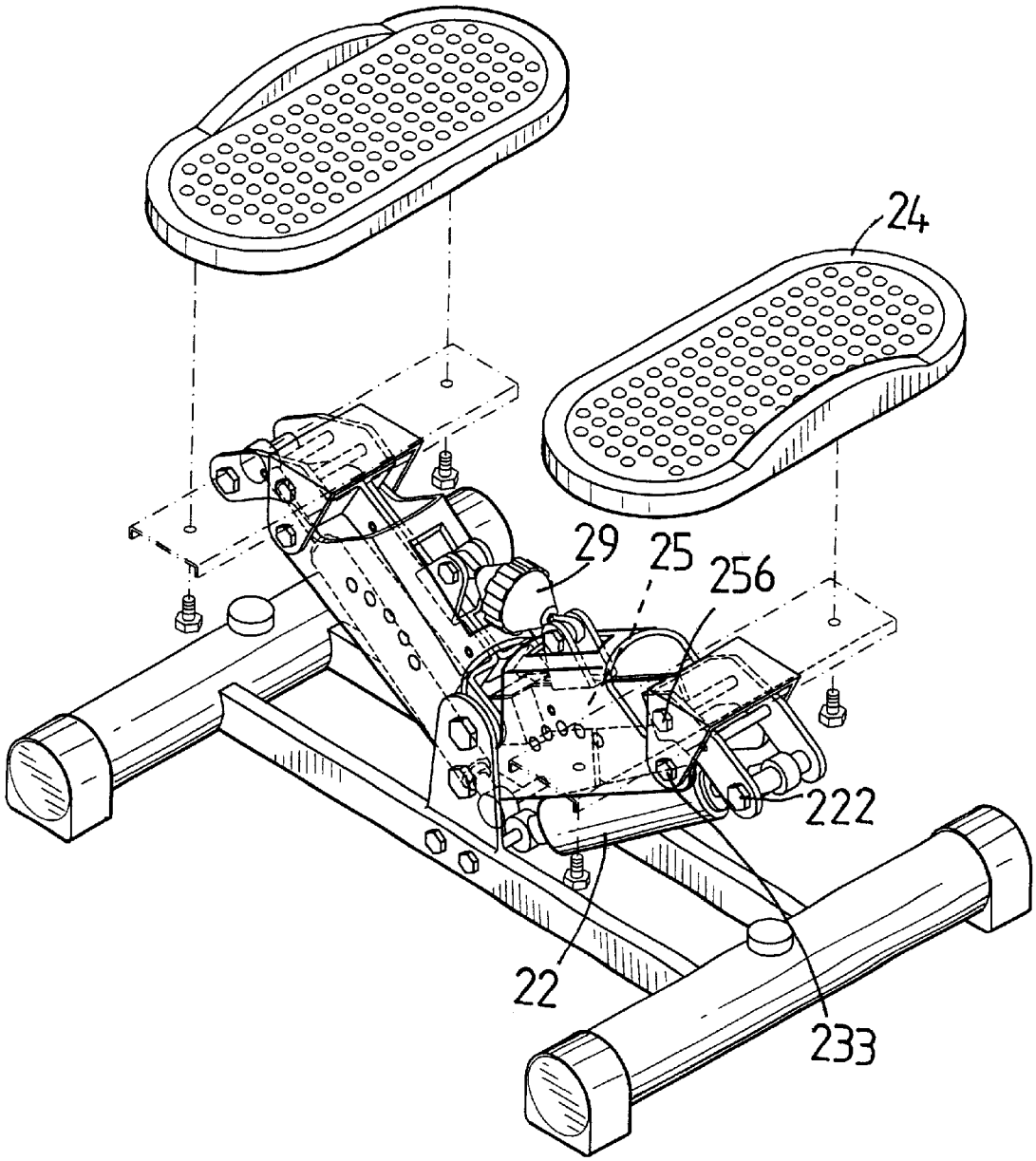
FIG. 3 shows the two pedals are to be connected to the links of the stair climbing exerciser of the present invention.
Figure 4:
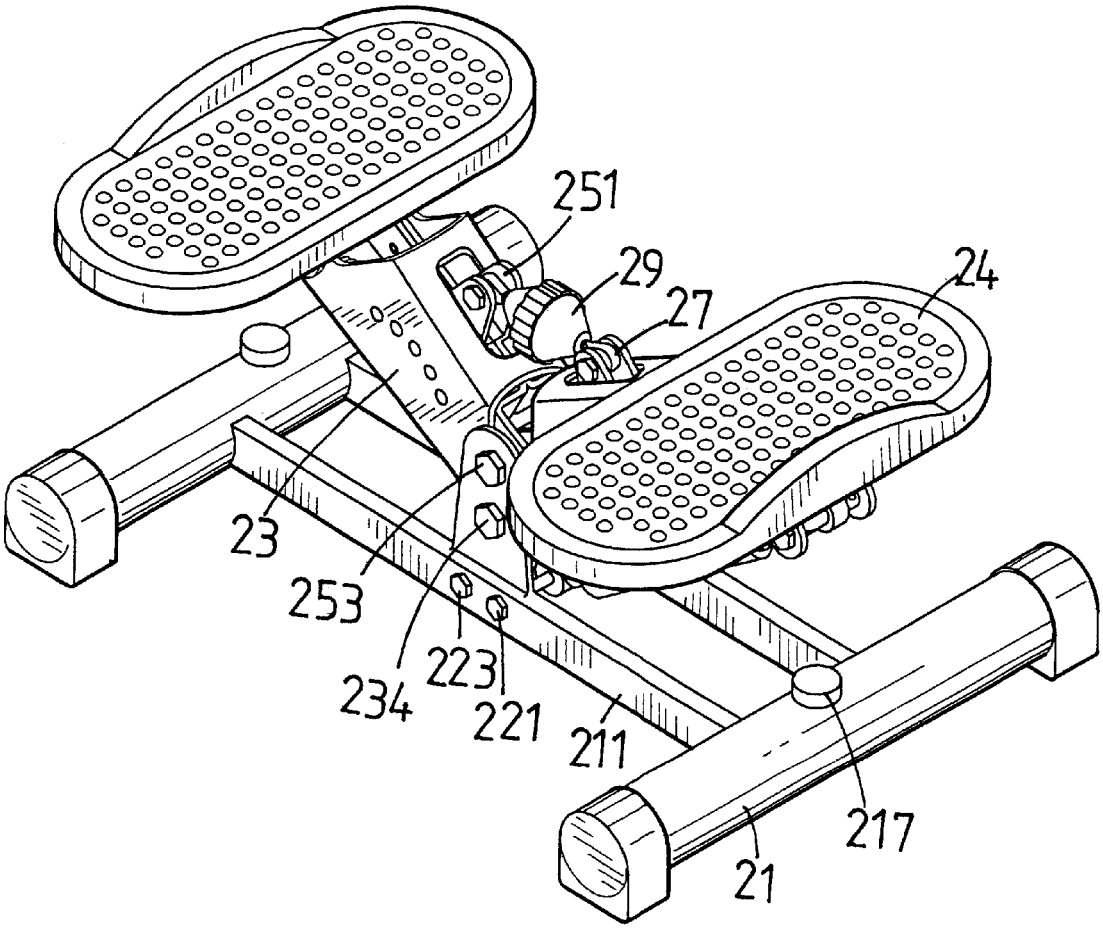
FIG. 4 is a perspective view to show the stair climbing exerciser of the present invention.

Referring to FIGS. 1 to 4, the stair climbing exerciser of the present invention comprises a frame including two bars 21 and two rails 211 connected between the two bars 21. Each rail 211 has a lug 212 extending therefrom and each bar 21 has a pad 217 for preventing impact by the cylinders 22 which will be described hereinafter.

Figure 8:
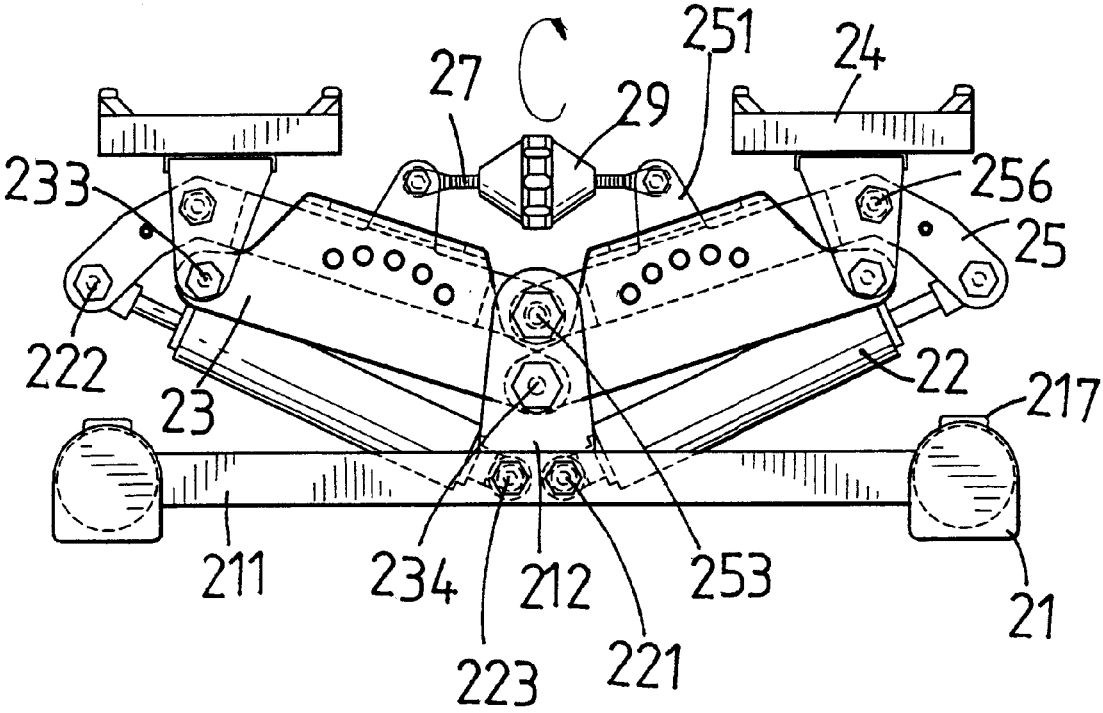
FIG. 8 shows the two links are pivoted to be away from each other by rotating the adjusting member.

Two links 25 each have a first end pivotably connected between the two lugs 212 by extending a bolt 253 extending through holes 216 in the two lugs 212 and holes 252 in the first end of each of the links 25. Two connection plates 251 extend from a mediate portion of each of the two links 25 and two extensions 254 extending from a second end of each of the links 25. Two damping members such as cylinders 22 each having a first end pivotably connected between the two rails 211 by extending a bolt 221/223 through holes 213/214 in the two rails 211 and the first end of each of the two cylinders 22. A second end of each of the cylinders 22 is pivotably connected to the two extensions 254 by extending a bolt 222 through holes 257 in the two extensions 254 and the second end of the cylinder 22. Each link 25 has a bolt 27 which is pivotably connected to the two connection plates 251 by extending a bolt 28 through holes 258 of the connection plates 251 and a hole 271 defined through an end of each of the two bolts 27. An adjusting member 29 is rotatably connected between the two bolts 27 by threadedly connecting to the two bolts 27 so that when rotating the adjusting member 29, the two links 25 are pivoted to be close to each other as shown in FIG. 5, or to be away from each other as shown in FIG. 8.

Two pedals 24 each include a support board 241 connected to an underside of the pedals 24 and each support board 241 includes two connection frames 242.

Two link covers 23 are respectively mounted to the two links 25 and each link cover 23 includes a first end pivotably connected to the two lugs 212 by extending a bolt 234 through holes 215 in the lugs 212 and holes 231 in the first end of the link cover 23. A second end of each link cover 23 is pivotably connected to the two connection frames 242 on the support board 241 by extending a bolt 233 through holes 232 in the second of the link cover 23 and holes 242 in the connection plates. Another bolt 256 extend through holes 255 in the two extensions 254 and holes 243 in the two connection frames 242 of the support board 241. An aperture 235 is defined through each of the link cover 23 for the connection plates 251 on the links 25 extending therethrough.

Figure 5:
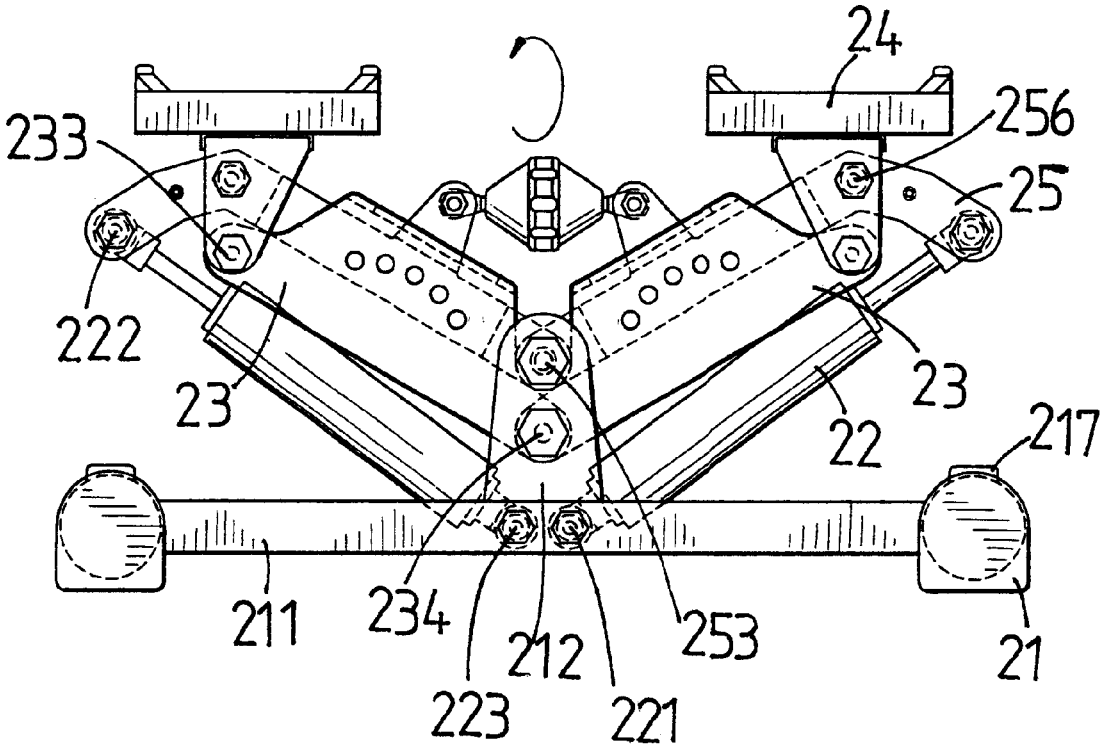
FIG. 5 shows the two links are pivoted to close to each other by rotating the adjusting member.
Figure 6:
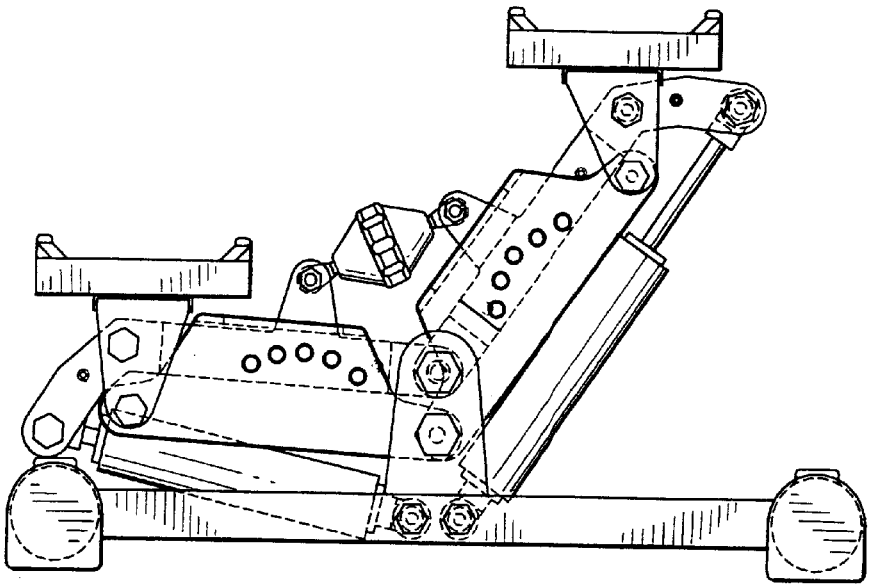
FIGS. 6 and 7 show the two pedals are stepped downward alternatively.
Figure 7:
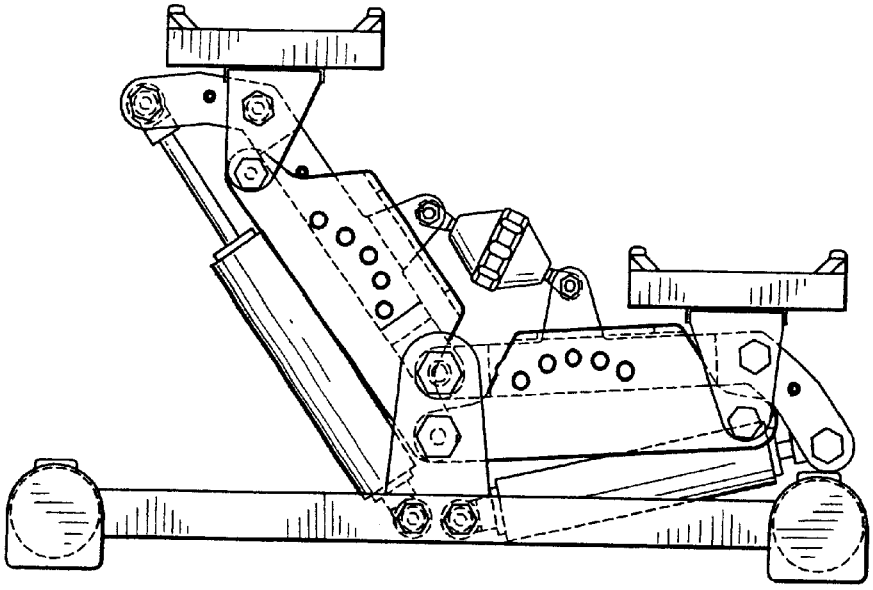
Figure 9:
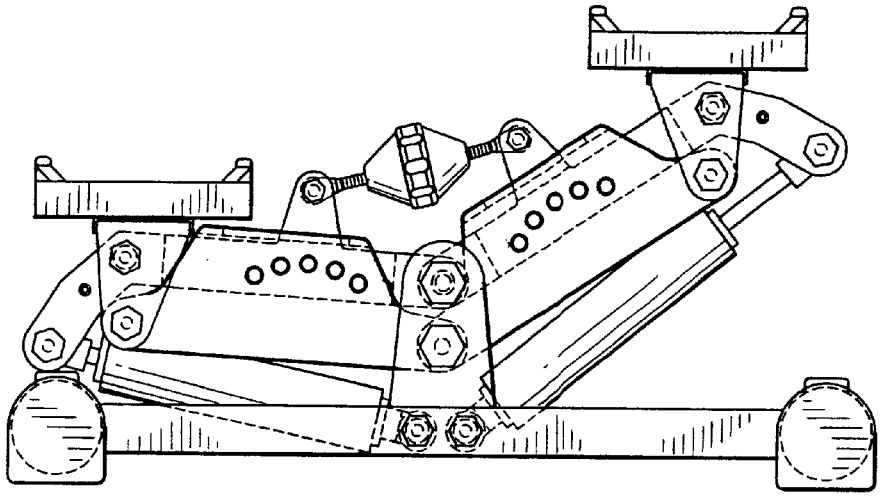
FIGS. 9 and 10 show the two pedals are stepped downward alternatively.
Figure 10:
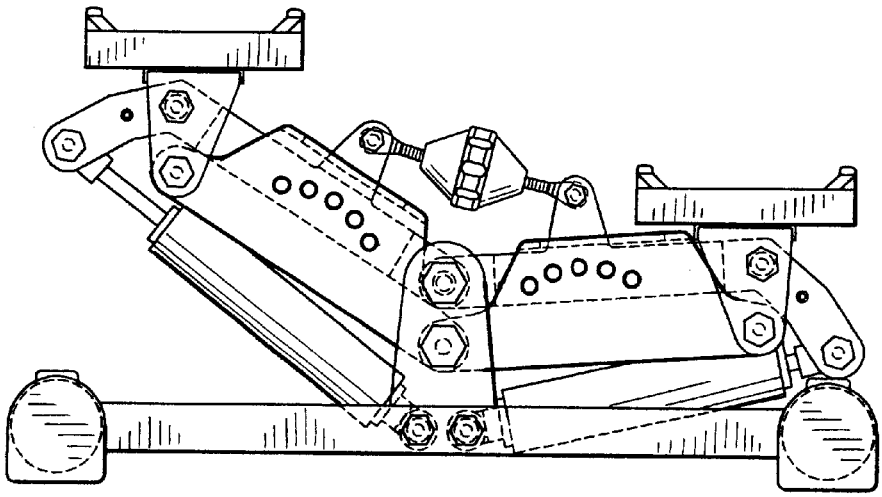
Figure 11:
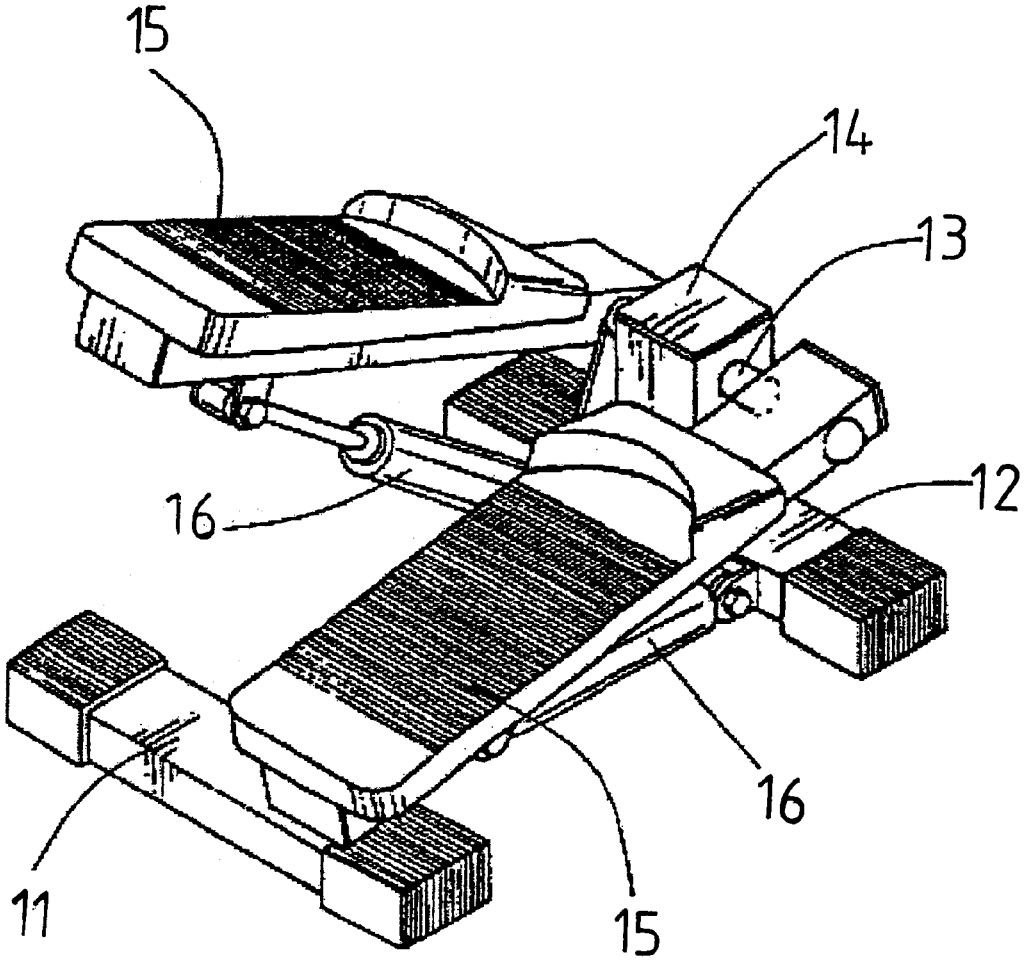
FIG. 11 PRIOR ART
FIG. 11 is a perspective view to show a first conventional stair climbing exerciser.
Figure 12:
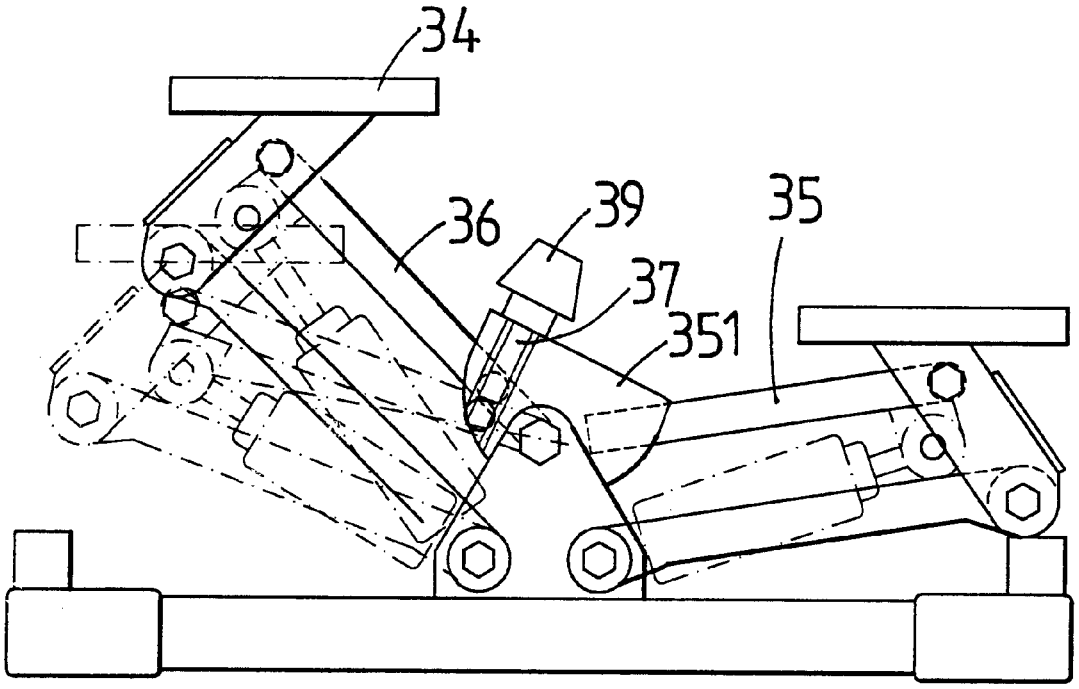
FIG. 12 PRIOR ART
FIG. 12 is a side view to show a second conventional stair climbing exerciser.

FIGS. 5 to 7 show that when the adjusting member 29 is rotated to pull the two links 25 pivotably close with each other, the height for each pedal 24 that can be moved is increased so that the user may alternatively step downward the pedals 24 with a longer travel distance. FIGS. 8 to 10 show that when the adjusting member 29 is rotated in opposite direction to pivot the two links 25 away from each other, the height for each pedal 24 that can be moved is decreased so that the user may alternatively step downward the pedals 24 with a shorter travel distance.

The travel distance of the two pedals 24 can be adjusted evenly and simultaneously by rotating the adjusting member 29.

While we have shown and described the embodiment in accordance with the present invention, it should be clear to those skilled in the art that further embodiments may be made without departing from the scope of the present invention.

What is claimed is:

1. A stair climbing exerciser comprising:

a frame including two bars and two rails connected between the two bars, each rail having a lug extending therefrom;

two links each having a first end pivotably connected between the two lugs, two damping members each having a first end pivotably connected between the two rails and a second end of each of the damping members being pivotably connected to a second end of the link corresponding thereto, each link having a bolt connected thereto and an adjusting member rotatably connected between the two bolts so that the two links are pivoted by rotating the adjusting member, and two pedals pivotably connected to the two respective second ends of the two links.

2. The stair climbing exerciser as claimed in claim 1, wherein each pedal has a connection frame which is pivotably mounted to the second end of the link corresponding thereto, two link covers respectively mounted to the two links and each including a first end pivotably connected to the two lugs, a second end of each link cover pivotably connected to connection frames extending from each of the pedals.

* * * * *